US010202818B2

(12) United States Patent
Hern et al.

(10) Patent No.: US 10,202,818 B2
(45) Date of Patent: Feb. 12, 2019

(54) EXPANDABLE SEALING ASSEMBLY AND DOWNHOLE SYSTEM

(71) Applicants: Christopher Ryan Hern, Porter, TX (US); Daniel Ewing, Katy, TX (US); Guijun Deng, The Woodlands, TX (US)

(72) Inventors: Christopher Ryan Hern, Porter, TX (US); Daniel Ewing, Katy, TX (US); Guijun Deng, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 22 days.

(21) Appl. No.: 15/380,521

(22) Filed: Dec. 15, 2016

(65) Prior Publication Data

US 2018/0171742 A1 Jun. 21, 2018

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS 4,736,799 A * 4/1988 Ahlstone ..... E21B 33/047 166/182
5,105,879 A 4/1992 Ross
5,511,620 A 4/1996 Baugh et al.
6,666,276 B1 * 12/2003 Yokley ..... E21B 23/01 166/118
6,705,615 B2 3/2004 Milberger et al.
7,367,404 B2 5/2008 Simpson et al.
7,748,467 B2 7/2010 Doane
7,784,797 B2 8/2010 Baugh et al.
7,905,492 B2 3/2011 Doane
8,109,340 B2 2/2012 Doane et al.
8,905,149 B2 12/2014 Bailey et al.
8,973,921 B2 3/2015 Doane
2015/0330175 A1 11/2015 Williams et al.
2018/0058172 A1 3/2018 Varghese et al.

OTHER PUBLICATIONS

"Cytadel ZX Electronically-Actuated Packer", Baker Hughes, 2014, 2 Pages.
"TORXS Expandable Liner Hanger System—Liner Systems", Baker Hughes, 2010, 2 Pages.

* cited by examiner

*Primary Examiner* — David J Bagnell
*Assistant Examiner* — Kristyn A Hall
(74) *Attorney, Agent, or Firm* — Cantor Colburn LLP

(57) ABSTRACT

A sealing assembly configured to seal within an annulus, the sealing assembly including a support body including a backing ring having a substantially wavy sectional shape, and a plurality of ribs extending radially outwardly from the backing ring; and, a sealing member supported on the support body, the sealing member including a radially exterior sealing component, at least a portion of the radially exterior sealing component disposed between adjacent ribs on a radial exterior surface of the hacking ring, and, a radially interior sealing component disposed on a radial interior surface of the backing portion.

20 Claims, 3 Drawing Sheets

EXPANDABLE SEALING ASSEMBLY AND DOWNHOLE SYSTEM

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

Tubular members having a sealing element such as a packer have been used to seal the annulus of cased wells. In one operation, after the well is drilled into the earth formation, a casing is run-in the open-hole formation, and a tubular member having a packer is run-in the cased well. The packer is designed to divide the well by sealing against the inner wall of the casing, thereby isolating a lower portion of the annulus from an upper portion of the annulus.

Expandable seals have been used for years in the oil industry with great success. These seals have been pushing the limit of oil producing capabilities as well pressures and temperatures are becoming more challenging. As these limits become more difficult to reach, new options must become available to push the envelope further. One type of seal uses a resilient member with an inner radial metal backing, and relative movement of the seal with respect to an inner cone results in radial expansion of the seal. Rubber pressure that forms as expandable seals are set has proven to be an obstacle that has limited the pressure capabilities due to a possibility of fracturing the metal backing of the sealing element as additional setting or boosting loads are applied to the seal.

The art would be receptive to improvements in expandable seals and methods of sealing in a downhole operation.

BRIEF DESCRIPTION

A sealing assembly configured to seal within an annulus, the sealing assembly including a support body including a backing ring having a substantially wavy sectional shape, and a plurality of ribs extending radially outwardly from the backing ring; and, a sealing member supported on the support body, the sealing member including a radially exterior sealing component, at least a portion of the radially exterior sealing component disposed between adjacent ribs on a radial exterior surface of the backing ring, and, a radially interior sealing component disposed on a radial interior surface of the backing portion.

A sealing assembly configured to seal within an annulus including a support body including a backing ring and a collet stop having a plurality of circumferentially arranged, radially outwardly projecting flanges and an extension connecting the flanges to an end of the backing ring; and, a sealing member supported on a radially exterior surface of the backing ring, the collet stop spaced from the sealing member.

A downhole assembly including an inner string having a portion with an outer surface having a frusto-conical shape; an outer structure, the inner string disposed within the outer structure; and, a sealing assembly configured to seal within an annulus between the outer surface of the inner string and the outer structure, the sealing assembly including a support body and a sealing member. The support body including a backing ring having a substantially wavy sectional shape, and a plurality of ribs extending radially outwardly from the backing ring. The sealing member supported on the support body, the sealing member including a radially exterior sealing component, at least a portion of the radially exterior sealing component disposed between adjacent ribs on a radial exterior surface of the backing ring; and, a radially interior sealing component disposed on a radial interior surface of the backing portion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
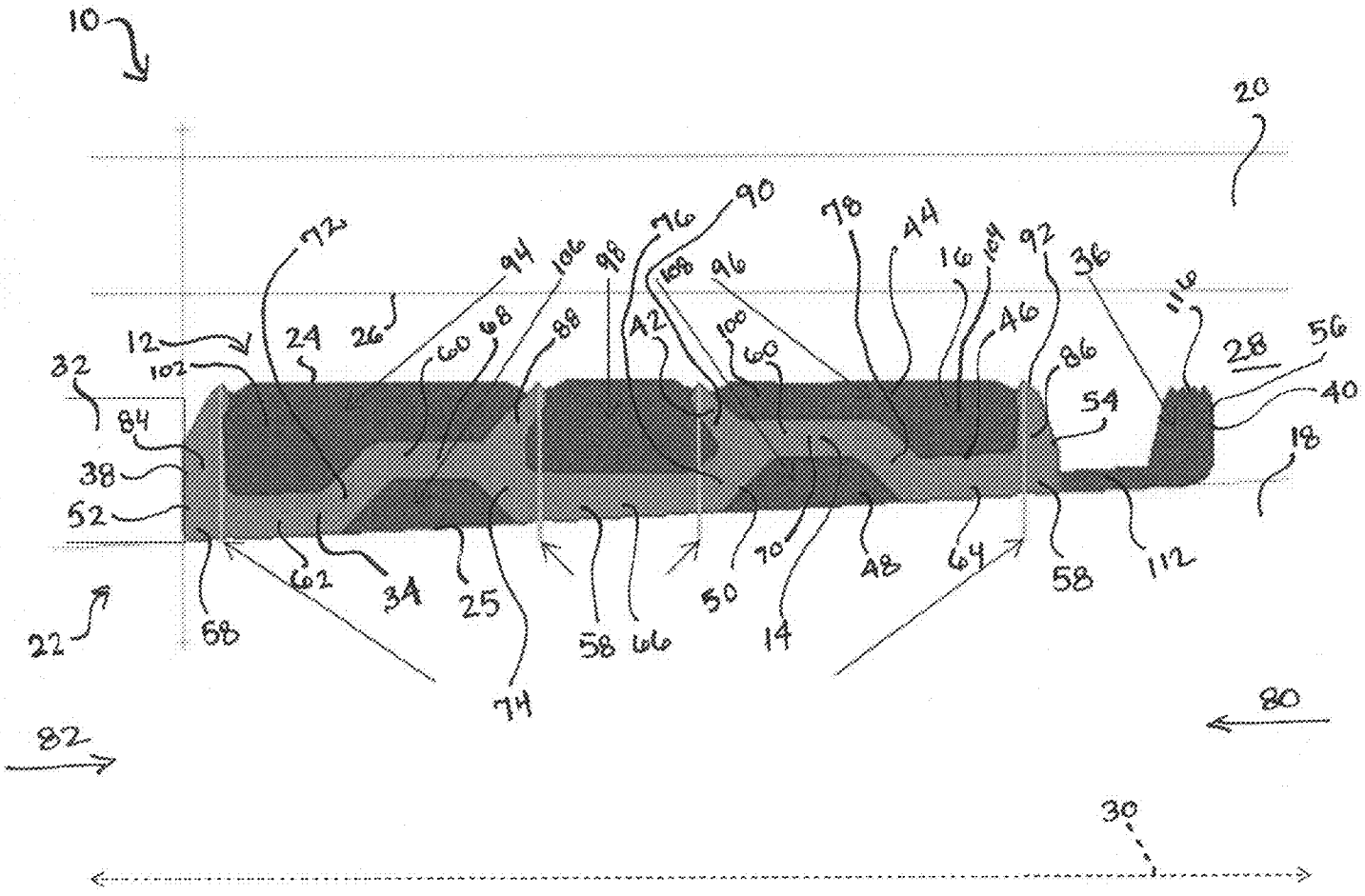
FIG. 1A depicts a partial sectional view of a downhole system including one embodiment of a sealing assembly in a first condition.
Figure 1B:
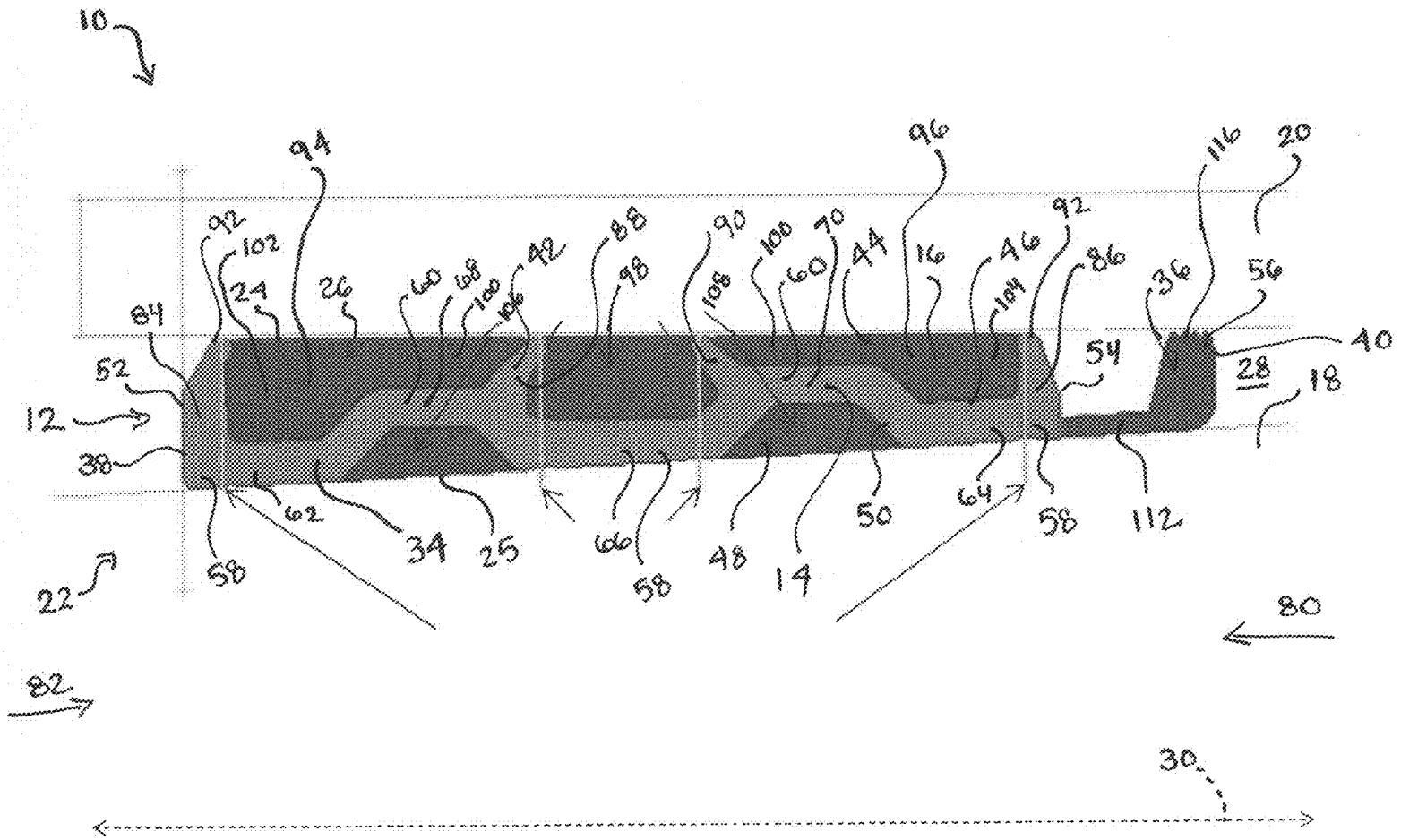
FIG. 1B depicts a partial sectional view of the downhole system including the sealing assembly in a second condition; and, FIG. 2 depicts a perspective view of a section of the sealing assembly of FIGS. 1A and 1B.

As shown in FIGS. 1A and 1B, one embodiment of a downhole system 10 includes an annular expandable sealing assembly 12 having at least a support body 14 and a sealing member 16. The sealing assembly 12 is supported on a radially interior structure 18 and positioned within an outer structure 20. The interior structure 18 may be a cone or wedging surface and may be part of a string 22 that includes any number of tubulars and/or downhole tools, which may be positioned uphole and/or downhole of the interior structure 18. The outer structure 20 may be an outer tubular such as, but not limited to, casing. The sealing assembly 12 is radially expandable, and FIG. 1A shows a first condition (such as a run-in condition) of the sealing assembly 12. In the first condition, an outer radial surface 24 of the sealing assembly 12 is spaced from the interior surface 26 of the outer structure 20. Thus, in one embodiment, the sealing assembly 12 and interior structure 18 may be run into the outer structure 20 in a first non-expanded condition of the sealing assembly 12, and the sealing assembly 12 may be subsequently radially expanded as shown in FIG. 1B by relative movement between the sealing assembly 12 and the interior structure 18 to contact the interior surface 26 of the outer structure 20 and block annulus 28. The relative movement between the sealing assembly 12 and the interior structure 18 may be accomplished through either movement of the interior structure 18, movement of the sealing assembly 12, or a combination of movement of the interior structure 18 and movement of the sealing assembly 12 relative to a longitudinal axis 30 of the sealing assembly 12. Devices 32 (FIG. 1A) for assisting in the relative movement may include, but are not limited to, a pusher collet, which in turn may be positionally restrained by a body lock ring. That is, a load can be supplied to the pusher collet, and the pusher collet can be attached to another sub that would have a body lock ring, maintaining the final position of the pusher collet.

The sealing member 16 of the sealing assembly 12 is supported on a backing ring 34 of the support body 14. In some embodiments, the support body 14 also includes a collet stop 36 that extends from the backing ring 34, and the backing ring 34 and the collet stop 36 can be integrally combined. The sealing assembly 12, within the length of the backing ring 34, is substantially cylindrically shaped on the outer radial surface 24, however an inner radial surface 25 of the sealing assembly 12 may include a frustoconical shape for sliding relative to the radially interior structure 18. The sealing assembly 12 extends lengthwise with respect to the longitudinal axis 30 of the sealing assembly 12. The sealing assembly 12 includes a first end 38 and a second end 40. In the illustrated embodiment, the second end 40 is defined by the collet stop 36, however if the sealing assembly 12 does not include the collet stop 36, then the second end 40 is defined by the backing ring 34.

The backing ring 34 of the support body 14 is substantially tubular-shaped and extends lengthwise of the support body 14. The support body 14 further includes a plurality of ribs 42 extending generally radially outwardly from the backing ring 34. The backing ring 34 is designed to expand as relative movement between the radially interior structure 18 and the support body 14 occurs. In one embodiment, the support body 14 (and optionally the collet stop 36 if integrally combined with the support body 14) is metal or at least includes metal, such as, but not limited to steel. The sealing member 16 of the sealing assembly 12 includes a radially exterior sealing component 44, at least a portion of the radially exterior sealing component 44 disposed between adjacent ribs 42 on a radial exterior surface 46 of the backing ring 34, and a radially interior sealing component 48 disposed on a radial interior surface 50 of the backing ring 34. While the radially exterior sealing component 44 is illustrated as including separate portions, it should be understood that the radially exterior sealing component 44 could also be formed as a continuous, one-piece portion, with the radially exterior sealing component 44 including portions that cover the radially outward ends of the one or more of the ribs in addition to portions that are disposed between adjacent ribs 42. In the illustrated embodiment, the radially interior sealing component 48 includes two separated portions 106, 108 (further described below), however it should be understood that the radially interior sealing component 48 may include any number of sealing portions. That is, the radially interior sealing component 48 may be inclusive of any one or more sealing portions disposed on the radial interior surface 50 of the backing ring 34. The backing ring 34 includes a first end 52 and a second end 54, and the collet stop 36 extends from the second end 54 of the backing ring 34 and provides a plurality of radially outwardly extending flanges 56 separated from the sealing member 16.

The backing ring 34 of the support body 14 is provided with a generally wavy or curvy sectional shape from the first end 52 to the second end 54. In one embodiment, the backing ring 34 includes a plurality of sections that alternate with respect to a location within a thickness of the sealing assembly 12. The plurality of sections include edge sections 58 extending longitudinally along the inner radial surface 25 of the sealing assembly 12 and embedded sections 60 extending longitudinally between the inner and outer radial surfaces 24, 25 of the sealing assembly 12. In the illustrated embodiment, the edge sections 58 include a first edge section 62 extending from the first end 52 of the backing ring 34, a second edge section 64 extending to the second end 54 of the backing ring 34, and a third or central edge section 66 disposed longitudinally between the first and second edge sections 62, 64 and along a longitudinally central area of the backing ring 34. A first embedded section 68 is disposed longitudinally between the first edge section 62 and the central edge section 66, and a second embedded section 70 is disposed longitudinally between the central edge section 66 and the second edge section 64. First, second, third, and fourth connecting sections 72, 74, 76, 78 are respectively interposed between the first edge section 62 and the first embedded section 68, the first embedded section 68 and the central edge section 66, the central edge section 66 and the second embedded section 70, and the second embedded section 70 and the second edge section 64. The edge sections 58 have inner diameter ranges that are configured to be flush with the outer diameter of the radially interior structure 18. The embedded sections 60 are disposed between the radially exterior sealing component 44 and the radially interior sealing component 48. Thus, the substantially wavy sectional shape of the backing ring 34 is configured to provide spring-like resiliency to the sealing assembly 12 upon receipt of an axial load in either or both opposing axial directions 80, 82. The flex in the backing ring 34 allows for designed balance between stresses in a metal backing ring 34. The flexing backing ring 34 also directs the additional energy from the pressure into the outer structure 20 and the interior structure 18, further engaging the sealing member 16, including radially exterior sealing component 44 and radially interior sealing component 48.

The ribs 42 that extend radially outwardly from the backing ring 34 include a first outer rib 84 at the first end 52 of the backing ring 34, and a second outer rib 86 at the second end 54 of the backing ring 34. The first and second outer ribs 84, 86 extend substantially perpendicularly with respect to the longitudinal axis 30. The plurality of ribs 42 further includes a first inner rib 88 and a second inner rib 90 that extend at non-perpendicular angles with respect to the longitudinal axis 30. The first inner rib 88 extends towards the second outer rib 86, and the second inner rib 90 extends towards the first outer rib 84. The first and second inner ribs 88, 90 are designed with tilted angles with respect to the longitudinal axis 30 to provide better extrusion barriers to each portion of the sealing member 16. The ribs 42 have outermost radial tips 92 that can contact the outer structure 20 upon radial expansion of the sealing assembly 12 (FIG. 1B) so as to create metal to metal contact interspersed with the contact the radially exterior sealing component 44 of the sealing member 16 makes with the outer structure 20. In an embodiment where the radially exterior sealing component 44 additionally covers the tips 92 of any of the ribs 42, the tips 92 may be covered in the non-expanded condition of the sealing assembly 12 (such as for run-in) but then may protrude through the radially exterior sealing component 44 upon expansion for contacting the outer structure 20. Although the outer ribs 84, 86 have a load path that is substantially perpendicular with respect to the longitudinal axis 30 and maintain a straight line of vertical contact externally to internally providing seal stiffness, the ribs 84, 86 may be slightly hooked at the tips 92 to allow for a bit of flexing when coming into initial contact with the outer structure 20. The first and second inner ribs 88, 90 do not maintain a straight line of vertical contact which allows for more flex of the inner ribs 88, 90 as compared to the outer ribs 84, 86. The hook shape at the tips 92 allows for a bit of spring in the radial direction of the sealing assembly 12 so thermal and pressure changes have less of a chance to unseat the ribs 42 from contact with the outer structure 20. Also, the flex allows for the ribs 42 to squeeze the radially exterior sealing component 44 allowing the material of the sealing component 44 to have increased material contact pressure on sealing surfaces on the outer structure 20. This squeeze on the sealing component 44 is also a support for the ribs 42 meaning that the compression of the sealing component 44 will also force the ribs 42 into deeper contact with the outer structure 20. This relationship means that any "boost pressure" will increase the engagement of the sealing assembly 12 without causing as much internal stress that may otherwise crack the backing ring 34.

The radially exterior sealing component 44 that is disposed between adjacent ribs 42 on the radial exterior surface 46 of the backing ring 34 includes a first portion 94 between the first outer rib 84 and the first inner rib 88, a second portion 96 between the second inner rib 90 and the second outer rib 86, and a central portion 98 between the first and second inner ribs 88, 90. As described above, the portions 94, 96, 98 may be at least initially connected to each other with portions over the tips 92 of the ribs 42. The first portion 94 and the second portion 96 each include a bridge portion 100 that is disposed on the first and second embedded sections 68, 70 of the backing ring 34, respectively. The first portion 94 also includes a first outermost portion 102 disposed on the first edge section 62, and the first connecting section 72. The first outermost portion 102 is thus thicker than the bridge portion 100 of first portion 94. Similarly, the second portion 96 includes a second outermost portion 104 disposed on the second edge section 64 and the fourth connecting section 78. The second outermost portion 104 is thicker than the bridge portion 100 of the second portion 96. In one embodiment, the first portion 94 is not subdivided by a rib 42 of the support body 14, and the second portion 96 is also not subdivided by a rib 42 of the support body 14. That is, the first outermost portion 102 is not separated from the bridge portion 100 in first portion 94 by a rib 42, and the second outermost portion 104 is not separated from the bridge portion 100 in second portion 96 by a rib 42. Having the thinnest portions (the bridge portions 100) of the radially exterior sealing component 44 contiguous with thicker portions (the first and second outermost portions 102, 104) prevents the radially exterior sealing component 44 from having thin, separated areas. That is, there are not ribs 42 provided on both sides of the bridge portions 100. The central portion 98 is disposed on the central edge section 66, and in one embodiment there is nothing else of the sealing assembly 12 radial interior to the central edge section 66, so the central portion 98 of the radially exterior sealing component 44 may be as thick as possible. Also, in one embodiment, areas of the central portion 98 of the radially exterior sealing component 44 are thicker than a thickness of the bridge portions 100, and thus the thinnest parts (bridge portions 100) of the radially exterior sealing component 44 are not centrally located with respect to the backing ring 34. This arrangement reduces internal stress on the sealing assembly 12, providing a more reliable seal that can hold at higher pressures. Also, more flex is permitted in the backing ring 34 by not having a sealing portion radial interior to the central edge section 66. The radially interior sealing component 48 of the sealing member 16 of the sealing assembly 12 is disposed on the radial interior surface 50 of the backing ring 34, and particularly on the radial interior surface of the first and second embedded sections 68, 70 of the backing ring 34. The radially interior sealing component 48 includes a first portion 106 and a second portion 108. The first and second portions 106, 108 of the radially interior sealing component 48 may be molded seals to reduce bridge flex of the embedded sections 60 by removing voids. The material of the sealing member 16 may be partially used to aid in the sealing process and is also used to prevent or at least partially discourage the ribs 42, such as metal ribs, from folding or cracking.

The inner radial surface 25 of the sealing assembly 12 thus includes the first, second, and central edge sections 62, 64, 66 and the collet stop 36 with the first portion 106 of the radially interior sealing component 48 disposed longitudinally between the first and central edge sections 62, 66 and the second portion 108 of the radially interior sealing component 48 disposed longitudinally between the central and second edge sections 66, 64. While the first and second portions 106, 108 with the first, second, and central edge sections 62, 64, 66 of the backing ring 34 may be substantially flush with the interior structure 18, in the illustrated embodiment shown in FIG. 2, the first and second portions 106, 108 may include a circumferential groove 110 to allow for sealing material reconfiguration during the radial expansion of the sealing assembly 12.

Figure 2:
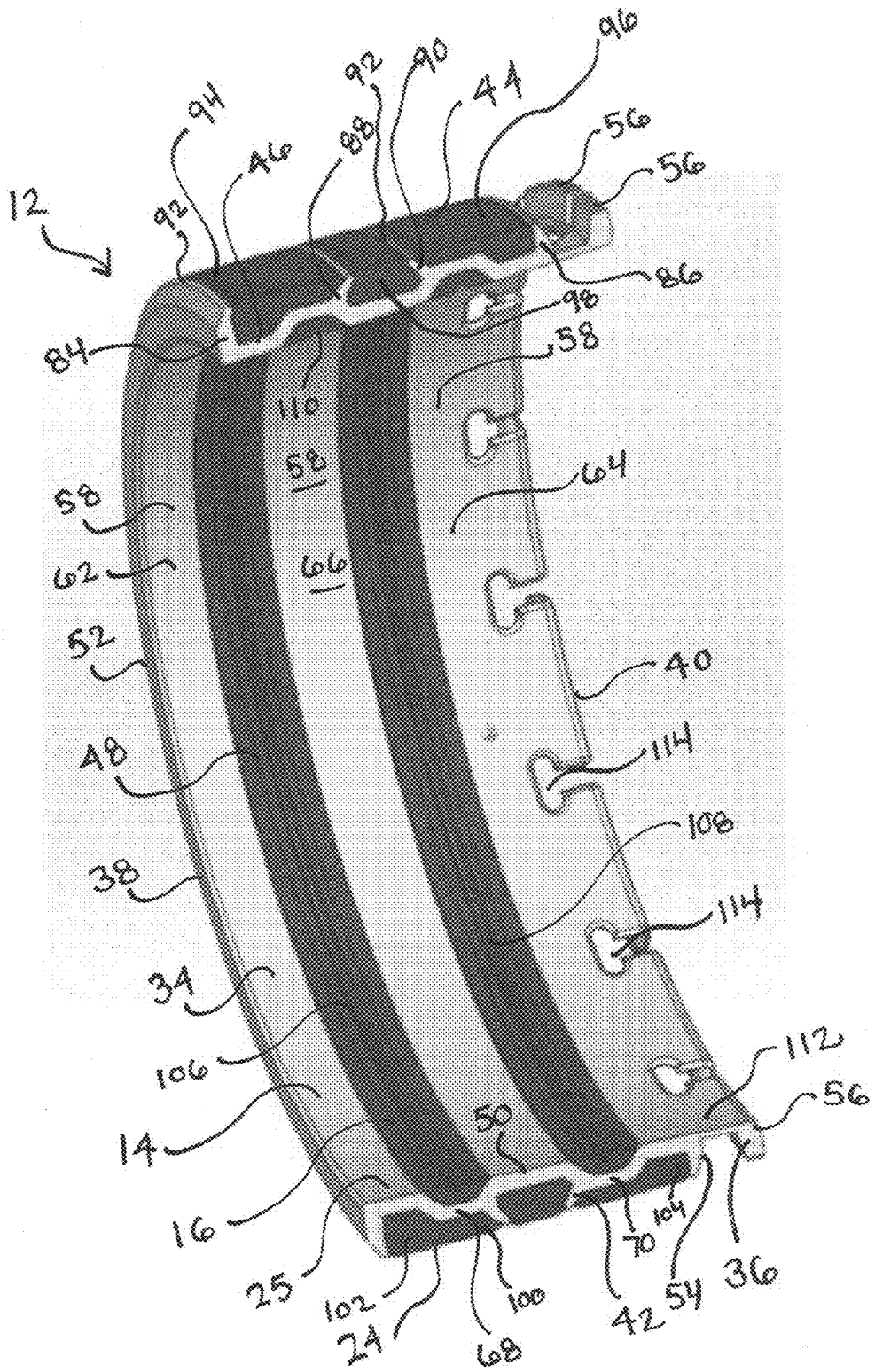

The collet stop 36 is provided at the second end 54 of the backing ring 34, in front of a direction of travel. In the illustrated embodiment, the seal may be moved in the direction 82 relative to movement of the interior structure 18 in a direction 80, however the seal assembly 12 can be reconfigured to move in the opposite direction. The collet stop 36 can be an integral part of the support body 14 such that the backing ring 34 and the collet stop 36 can be one continuous integrally formed member, as shown in FIG. 2. The collet stop 36 enables the sealing assembly 12 to brace itself in the outer structure 20 without increasing the setting force. The collet stop 36 includes an extension 112 extending from the second end 54 of the backing ring 34. The extension 112 may be substantially continuous with the second edge section 64 of the backing ring 34. The extension 112 may include a plurality of circumferentially spaced cutouts 114 (FIG. 2) that separate the plurality of radially projecting flanges 56 from each other. The outermost radial ends of the flanges 56 may further include an arrangement of gripping features, such as, but not limited to teeth 116 for additionally engaging with the interior surface 26 of the outer structure 20. The built-in teeth 116 on the collet stop 36 can prevent recoil (body lock ring backlash) by biting into the outer structure 20 at the end of a setting process. If a body lock ring, which ratchets and allows one directional movement, is included as one of the devices 32, it will ratchet during relative movement of the seal assembly 12 and the interior structure 18. Without the collet stop 36, the sealing assembly 12 may slop back if it does not reach a thread peak of the body lock ring, however the collet stop 36 will enable a reduction in slop. In some embodiments, a body lock ring that is not fully ratcheted can allow up to 1/12" of an inch of slack in the downhole system 10, and even such a slight shift could potentially allow for a sealing assembly to have reduced contact with the outer structure 20. The collet stop 36 thus prevents over-travel, such as during pressure reversal, of the sealing assembly 12 (acts as a travel limiter so as to not overload the sealing assembly 12), reduces risk of body lock ring slack, does not reduce the rubber volume which is beneficial for changes in temperature, has teeth 116 which will be able to provide hold down load (ensuring that the sealing assembly 12 will be less likely to shift post-setting), and can further act as a hold down slip.

In one embodiment, the sealing member 16 includes any material or combination of materials that is selected to provide an appropriate seal with the interior structure 18 and the outer structure 20. The material may be the same for both the radially exterior sealing component 44 and the radially interior sealing component 48, or alternatively the material for the radially exterior sealing component 44 may be different than the material for the radially interior sealing component 48, and each component 44, 48 may include the same or different materials therein. Further, the material for the sealing member 16 is different than a material used for the support body 14. In one embodiment, the sealing member 16 may include, but is not limited to, an elastomer, such as rubber or bonded rubber. In another embodiment, the sealing member 16 may include, but is not limited to, a polymer, including plastics such as, but not limited to PEEK or PTFE. In yet another embodiment, the sealing member 16 may include, but is not limited to, a metal that is softer than a metal used in the support body 14. While particular embodiments are disclosed, the sealing member 16 is not limited to the listed embodiments and may include any material or combination of materials that provide the appropriate sealing required in the downhole system 10. The sealing member 16 may possess a higher Poisson's ratio (ratio of transverse strain to axial strain) as compared to the backing ring 34. The sealing member 16 is formed of a material that will enable the sealing assembly 12 to spread the contact load that forms when the radially exterior sealing component 44 contacts the outer structure 20 during radial expansion, to prevent high concentration areas. The outer structure 20 may have some defects on its interior surface 26, so the sealing member 16 has some conformability to spread within the defects to provide a sufficient seal. Also, providing separate portions 44, 48 of the sealing member 16 can improve reliability. While a particular arrangement of portions 44, 48 has been described, embodiments of the sealing assembly may include an alternate arrangement, such as including additional portions is the sealing assembly 12 is to be extended lengthwise.

Due to the shape of the backing ring 34, the sealing assembly 12 is provided with spring-like action, so that the sealing assembly 12 can shrink in the axial direction with respect to longitudinal axis 30. This is advantageous because when the seal assembly 12 receives pressure from above or pressure from below within the annulus 28, the backing ring 34 can shrink in the axial direction and transfer the load to a radial direction to achieve more sealing in the face of such increased pressure. The curvy shaped backing ring 34 reduces section stiffness in the backing ring 34 so it can flex in the axial direction. Thus, pressure encountered from either above or below the sealing assembly 12 will energize the sealing components 44, 48 of the sealing assembly 12, and boosts seal ratings. The seal geometry uses the increase in rubber pressure as an energizer to increase the contact pressure of the ribs 42 by forcing the ribs 42 into stronger contact with the outer structure 20. The curvy shaped backing ring 34 enables the seal assembly 12 to flex in axial direction, and diverts axial energy when pressure is encountered above or below to radial direction, therefore, energizing the seal components 44, 48, and any additional "set load" that the seal sees will increase the effectiveness of the sealing assembly 12. Increasing pressure ratings can be achieved using the sealing assembly 12, such as achieving a rating of 20,000 psi. The integral collet stop 36 also acts as a travel limiter and prevents the seal assembly 12 from slacking off after setting due to body lock ring slop.

As there is no central bridge portion in the radially exterior sealing component 44, stress is not concentrated in such a bridge portion. Also, as the ribs 42 may be limited to the first and second inner ribs 88, 90 and the first and second outer ribs 84, 86, the sealing member 16 includes more sealing material per sealing portion, thus improving conformability to a non-perfect outer structure 20. Thus, as-rolled casing or casing with defects are suitable as the outer structure 20 for use with the sealing assembly 12.)

Set forth below are some embodiments of the foregoing disclosure:

Embodiment 1

A sealing assembly configured to seal within an annulus, the sealing assembly including a support body including a backing ring having a substantially sectional shape, and a plurality of ribs extending radially outwardly from the backing ring; and, a sealing member supported on the support body, the sealing member including a radially exterior sealing component, at least a portion of the radially exterior sealing component disposed between adjacent ribs on a radial exterior surface of the backing ring, and, a radially interior sealing component disposed on a radial interior surface of the backing portion.

Embodiment 2

The sealing assembly of any of the preceding embodiments, wherein the sealing assembly has an inner radial surface and an outer radial surface, the backing ring including edge sections extending longitudinally along the inner radial surface and embedded sections extending longitudinally between the inner and outer radial surfaces.

Embodiment 3

The sealing assembly of any of the preceding embodiments, wherein the embedded sections of the backing ring alternate between the edge sections of the backing ring.

Embodiment 4

The sealing assembly of any of the preceding embodiments, wherein the edge sections of the hacking ring include a first edge section located at a first end of the backing ring, a second edge section located at a second end of the backing ring, and a third edge section disposed along a longitudinally central area of the hacking ring.

Embodiment 5

The sealing assembly of any of the preceding embodiments, wherein the embedded sections of the hacking ring include a first embedded section disposed longitudinally between the first and third edge sections, and a second embedded section disposed longitudinally between the second and third edge sections.

Embodiment 6

The sealing assembly of any of the preceding embodiments, wherein the embedded sections are disposed between the radially exterior sealing component and the radially interior sealing component.

Embodiment 7

The sealing assembly of any of the preceding embodiments, wherein the radially exterior sealing component extends longitudinally along the outer radial surface of the sealing assembly and includes bridge portions extending along the embedded sections of the backing ring, the bridge portions having a smaller thickness than a thickness of the radially exterior sealing component located at the edge sections of the backing ring.

Embodiment 8

The sealing assembly of any of the preceding embodiments, wherein a central edge section of the edge sections of the backing ring is disposed along a longitudinally central area of the backing ring, and the radially interior sealing component includes a first portion and a second portion separated by the central edge section.

Embodiment 9

The sealing assembly of any of the preceding embodiments, wherein the plurality of ribs includes first and second outer ribs extending from first and second ends of the backing ring and from edge sections of the backing ring, and the plurality of ribs further includes first and second inner ribs extending from first and second embedded sections of the backing ring.

Embodiment 10

The sealing assembly of any of the preceding embodiments, wherein the radially exterior sealing component includes a first portion between the first outer rib and the first inner rib, a second portion between the second outer rib and the second inner rib, and a central portion between the first and second inner ribs, the first and second portions each including a bridge portion extending along a respective embedded section.

Embodiment 11

The sealing assembly of any of the preceding embodiments, wherein the first and second outer ribs are substantially perpendicular to a longitudinal axis of the sealing assembly, and the first and second inner ribs extend at non-perpendicular angles with respect to the longitudinal axis.

Embodiment 12

The sealing assembly of any of the preceding embodiments, wherein the substantially wavy sectional shape of the backing ring is configured to provide spring-like resiliency to the sealing assembly in an axial direction upon receipt of an axial load.

Embodiment 13

The sealing assembly of any of the preceding embodiments, wherein a first end of the backing ring has an inner diameter that is less than an inner diameter of a second end of the backing ring.

Embodiment 14

The sealing assembly of any of the preceding embodiments, wherein the support body further includes a collet stop extending from the backing ring, the collet stop including a plurality of circumferentially arranged outwardly radially projecting flanges.

Embodiment 15

The sealing assembly of any of the preceding embodiments, wherein the collet stop is integral with the backing ring and ribs.

Embodiment 16

The sealing assembly of any of the preceding embodiments, wherein the flanges include a plurality of teeth.

Embodiment 17

The sealing assembly of any of the preceding embodiments, wherein a first end of the backing ring has an inner diameter that is less than an inner diameter of a second end of the backing ring, and the inner diameter of the second end of the backing ring is less than an inner diameter of the collet stop.

Embodiment 18

A sealing assembly configured to seal within an annulus, the sealing assembly including a support body and a sealing member. The support body including a backing ring and a collet stop including a plurality of circumferentially arranged, radially outwardly projecting flanges and an extension connecting the flanges to an end of the backing ring. The sealing member supported on a radially exterior surface of the backing ring, the collet stop spaced from the sealing member.

Embodiment 19

The sealing assembly of any of the preceding embodiments, wherein the flanges include a plurality of teeth.

Embodiment 20

A downhole assembly including an inner string having a portion with an outer surface having a frusto-conical shape; an outer structure, the inner string disposed within the outer structure; and, a sealing assembly configured to seal within an annulus between the outer surface of the inner string and the outer structure. The sealing assembly includes a support body and a sealing member. The support body includes a backing ring having a substantially wavy sectional shape, and a plurality of ribs extending radially outwardly from the backing ring. The sealing member is supported on the support body and includes a radially exterior sealing component, at least a portion of the radially exterior sealing component disposed between adjacent ribs on a radial exterior surface of the backing ring, and, a radially interior sealing component disposed on a radial interior surface of the backing portion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed:

1. A sealing assembly configured to seal within an annulus, the sealing assembly comprising:

a support body including:

a backing ring; and, a plurality of ribs extending radially outwardly from the backing ring, the plurality of ribs including first and second outer ribs extending from first and second ends of the backing ring, the first and second outer ribs extending substantially perpendicularly with respect to a longitudinal axis of the sealing assembly, and the plurality of ribs further including first and second inner ribs extending from the backing ring non-perpendicularly with respect to the longitudinal axis, the first and second inner ribs having more flex as compared to the first and second outer ribs; and, a sealing member supported on the support body, the sealing member including:

a radially exterior sealing component, at least a portion of the radially exterior sealing component disposed between adjacent ribs and on a radial exterior surface of the backing ring; and, a radially interior sealing component disposed on a radial interior surface of the backing ring.

2. The sealing assembly of claim 1, wherein the sealing assembly has an inner radial surface and an outer radial surface, the backing ring including edge sections extending longitudinally along the inner radial surface and embedded sections extending longitudinally between the inner and outer radial surfaces.

3. The sealing assembly of claim 2, wherein the embedded sections of the backing ring alternate between the edge sections of the backing ring.

4. The sealing assembly of claim 2, wherein the edge sections of the backing ring include a first edge section located at the first end of the backing ring, a second edge section located at the second end of the backing ring, and a third edge section disposed along a longitudinally central area of the backing ring.

5. The sealing assembly of claim 4, wherein the embedded sections of the backing ring include a first embedded section disposed longitudinally between the first and third edge sections, and a second embedded section disposed longitudinally between the second and third edge sections.

6. The sealing assembly of claim 2, wherein the embedded sections are disposed between the radially exterior sealing component and the radially interior sealing component.

7. The sealing assembly of claim 6, wherein the radially exterior sealing component extends longitudinally along the outer radial surface of the sealing assembly and includes bridge portions extending along the embedded sections of the backing ring, the bridge portions having a smaller thickness than a thickness of the radially exterior sealing component located at the edge sections of the backing ring.

8. The sealing assembly of claim 2, wherein a central edge section of the edge sections of the backing ring is disposed along a longitudinally central area of the backing ring, and the radially interior sealing component includes a first portion and a second portion separated by the central edge section.

9. The sealing assembly of claim 2, wherein the first and second outer ribs extend from edge sections of the backing ring, and the first and second inner ribs extend from first and second embedded sections of the backing ring.

10. The sealing assembly of claim 9, wherein the radially exterior sealing component includes a first portion between the first outer rib and the first inner rib, a second portion between the second outer rib and the second inner rib, and a central portion between the first and second inner ribs, the first and second portions each including a bridge portion extending along a respective embedded section.

11. The sealing assembly of claim 1, wherein the backing ring is configured to provide spring-like resiliency to the sealing assembly in an axial direction upon receipt of an axial load.

12. The sealing assembly of claim 1, wherein the sealing assembly is configured to seal within the annulus between an interior structure and an outer structure, and the support body further includes a collet stop extending from the backing ring, the collet stop including a plurality of circumferentially arranged outwardly radially projecting flanges, the plurality of ribs configured to contact the outer structure upon expansion of the sealing assembly, and the plurality of flanges configured to engage with an interior surface of the outer structure at an end of a setting process.

13. The sealing assembly of claim 12, wherein the collet stop is integral with the backing ring and ribs.

14. The sealing assembly of claim 12, wherein the flanges include a plurality of teeth.

15. The sealing assembly of claim 12, wherein the first end of the backing ring has an inner diameter that is less than an inner diameter of the second end of the backing ring, and the inner diameter of the second end of the backing ring is less than an inner diameter of the collet stop.

16. A sealing assembly configured to seal within an annulus between an interior structure and an outer structure, the sealing assembly comprising:

a support body including:

a backing ring having a first end a second end, an inner diameter of the backing ring at the first end is less than an inner diameter of the backing ring at the second end; and, a collet stop including a plurality of circumferentially arranged, radially outwardly projecting flanges and an extension connecting the flanges to the second end of the backing ring, outermost radial ends of the flanges configured to engage with an interior surface of the outer structure at an end of a setting process of the sealing assembly; and, a sealing member supported on a radially exterior surface of the backing ring, the collet stop spaced from the sealing member.

17. The sealing assembly of claim 16, wherein the outermost radial ends of the flanges include a plurality of teeth.

18. A downhole assembly including:

an inner string having a portion with an outer surface having a frusto-conical shape;

an outer structure, the inner string disposed within the outer structure; and, a sealing assembly configured to seal within an annulus between the outer surface of the inner string and the outer structure, the sealing assembly comprising:

a support body including:

a backing ring;

a plurality of ribs extending radially outwardly from the backing ring, the plurality of ribs configured to contact the outer structure upon radial expansion of the sealing assembly; and, a collet stop extending from an end of the backing ring, the collet stop including a plurality of radially projecting flanges including teeth, the teeth configured to engage with the outer structure at an end of a setting process of the sealing assembly;

a sealing member supported on the support body, the sealing member including:

a radially exterior sealing component, at least a portion of the radially exterior sealing component disposed between adjacent ribs on a radial exterior surface of the backing ring; and, a radially interior sealing component disposed on a radial interior surface of the backing ring.

19. The downhole assembly of claim 18, wherein the plurality of ribs includes first and second outer ribs extending from first and second ends of the backing ring, the first and second outer ribs are substantially perpendicular to a longitudinal axis of the sealing assembly, and the plurality of ribs further includes first and second inner ribs extending from the backing ring the first and second inner ribs extend at non-perpendicular angles with respect to the longitudinal axis.

20. The sealing assembly of claim 18, wherein the backing ring has a first end a second end, the first end of the backing ring has an inner diameter that is less than an inner diameter of the second end of the backing ring, and the collet stop extends from the second end of the backing ring.

* * * * *